US009828554B2

(12) United States Patent
Spicer et al.

(10) Patent No.: US 9,828,554 B2
(45) Date of Patent: Nov. 28, 2017

(54) PROCESS AND APPARATUS FOR DECOKING A HYDOCARBON STEAM CRACKING FURNACE

(71) Applicant: ExxonMobil Chemical Patents Inc., Baytown, TX (US)

(72) Inventors: David B. Spicer, Houston, TX (US); Subramanian Annamalai, Choa Chu Kang (SG); William A. Aslaner, League City, TX (US)

(73) Assignee: ExxonMobil Chemical Patent Inc., Baytown, TX (US)

( * ) Notice: Subject to any disclaimer, the term of this patent is extended or adjusted under 35 U.S.C. 154(b) by 195 days.

(21) Appl. No.: 14/821,528

(22) Filed: Aug. 7, 2015

(65) Prior Publication Data

US 2016/0168479 A1 Jun. 16, 2016

Related U.S. Application Data

(60) Provisional application No. 62/092,623, filed on Dec. 16, 2014.

(30) Foreign Application Priority Data

Jan. 15, 2015 (EP) ..... 15151257

(51) Int. Cl.

| | |
|---|---|
| ***C10G 9/16*** | (2006.01) |
| ***C10G 9/20*** | (2006.01) |
| ***C10G 9/36*** | (2006.01) |

(52) U.S. Cl.

CPC ..... *C10G 9/16* (2013.01); *C10G 9/20* (2013.01); *C10G 9/36* (2013.01); *C10G 2300/802* (2013.01); *C10G 2300/807* (2013.01)

(58) Field of Classification Search

CPC ... C10G 9/16; C10G 9/36; C10G 9/20; C10G 2300/807; C10G 2300/802

See application file for complete search history.

(56) References Cited

U.S. PATENT DOCUMENTS

| | | | |
|---|---|---|---|
| 3,593,968 | A | 7/1971 | Geddes |
| 3,758,081 | A | 9/1973 | Prudhon |
| 3,907,661 | A | 9/1975 | Gwyn et al. |
| 3,959,420 | A | 5/1976 | Geddes et al. |
| 4,444,697 | A | 4/1984 | Gater et al. |
| 5,061,408 | A | 10/1991 | Hüning et al. |
| 5,183,642 | A | 2/1993 | Lenglet |
| 6,626,424 | B2 | 9/2003 | Ngan et al. |
| 6,632,351 | B1 | 10/2003 | Ngan et al. |
| 7,090,765 | B2 | 8/2006 | Spicer |
| 7,097,758 | B2 | 8/2006 | Stell et al. |
| 7,138,047 | B2 | 11/2006 | Stell et al. |
| 7,220,887 | B2 | 5/2007 | Stell et al. |

(Continued)

*Primary Examiner* — Randy Boyer
*Assistant Examiner* — Juan Valencia

(57) ABSTRACT

The invention relates a process for removing coke formed during steam-cracking of a hydrocarbon feed. The process includes providing a decoking feed to at least one radiant coil of a steam-cracking furnace under conditions to remove at least a portion of coke from the at least one radiant coil to form a decoking effluent. The decoking effluent is cooled with a liquid quench medium to provide an partially-quenched decoking effluent. The partially-quenched decoking effluent is cooled with a gaseous quench medium to provide a quenched effluent. An apparatus configured to perform such a process is also described.

20 Claims, 1 Drawing Sheet

(56) References Cited

U.S. PATENT DOCUMENTS

| | | | |
|---|---|---|---|
| 7,235,705 | B2 | 6/2007 | Stell |
| 7,244,871 | B2 | 7/2007 | Stell et al. |
| 7,247,765 | B2 | 7/2007 | Stell et al. |
| 7,297,833 | B2 | 11/2007 | Beattie et al. |
| 7,311,746 | B2 | 12/2007 | Stell et al. |
| 7,312,371 | B2 | 12/2007 | Stell et al. |
| 7,351,872 | B2 | 4/2008 | Stell et al. |
| 7,488,459 | B2 | 2/2009 | Stell et al. |
| 7,578,929 | B2 | 8/2009 | Stell et al. |
| 7,820,035 | B2 | 10/2010 | McCoy et al. |
| 8,177,200 | B2 | 5/2012 | Spicer et al. |
| 2005/0261532 | A1 | 11/2005 | Stell et al. |
| 2008/0128323 | A1 | 6/2008 | McCoy et al. |
| 2010/0320119 | A1 | 12/2010 | Ou et al. |
| 2013/0239999 | A1 | 9/2013 | Bhirud |

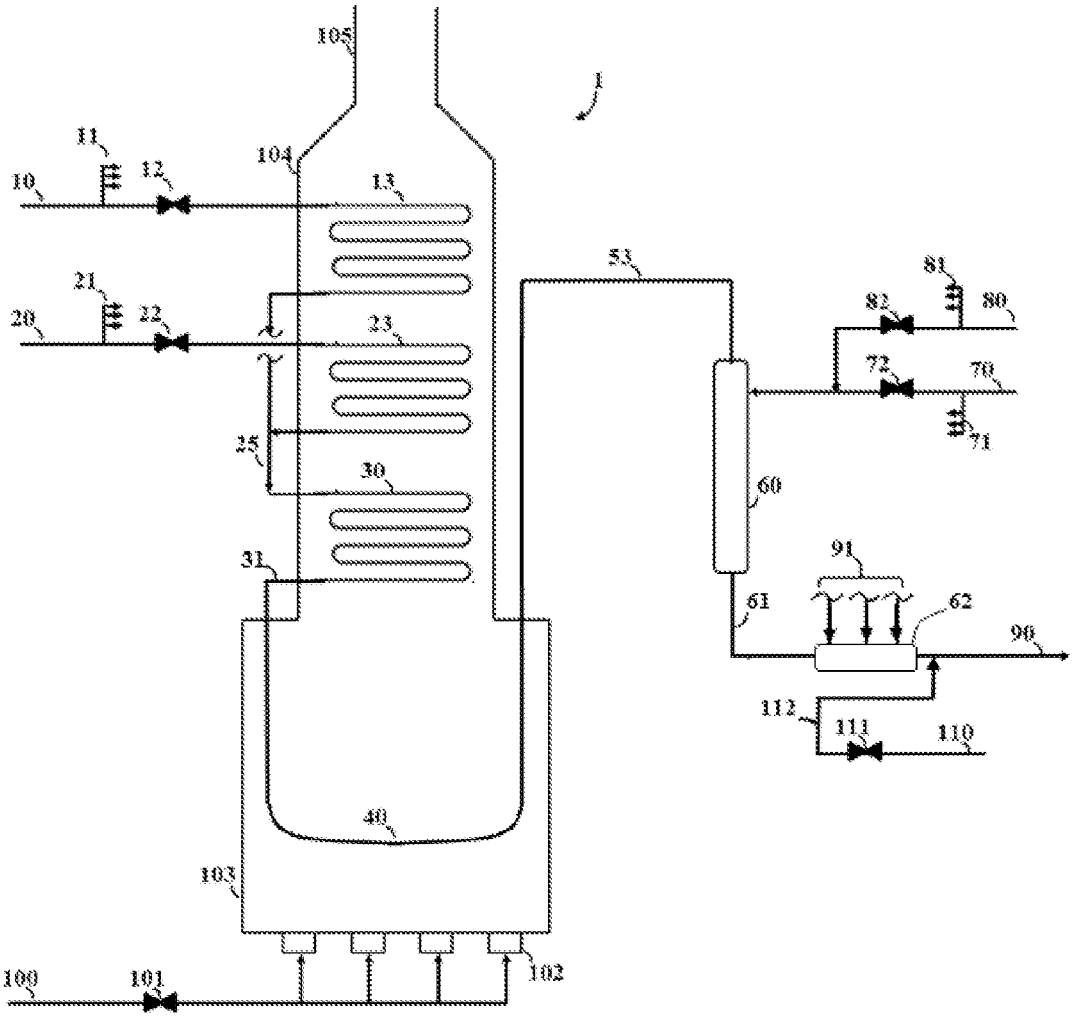
105
1
11
104
10
12
13
53
81
21
82
80
20
22
23
72
70
71
25
30
60
91
31
61
62
90
112
111
110
40
103
100
101
102

PROCESS AND APPARATUS FOR DECOKING A HYDOCARBON STEAM CRACKING FURNACE

CROSS-REFERENCE TO RELATED APPLICATIONS

This application claims priority to and the benefit of application of U.S. Provisional Application Ser. No. 62/092,623, filed Dec. 16, 2014 and EP 15151257.1 filed Jan. 15, 2015, the entireties are incorporated herein by reference. Also noted is related application U.S. Provisional Application Ser. No. 62/042,920 filed Aug. 28, 2014.

FIELD OF INVENTION

The invention relates to thermal cracking hydrocarbons for the production of olefins, particularly low molecular weight olefins such as ethylene. More particularly the invention relates to methods and equipment for removal of coke deposits that form during such thermal cracking processes.

BACKGROUND OF INVENTION

Thermal cracking of hydrocarbon feeds in the presence of steam ("steam cracking") is a commercially important technology for producing light olefins such as ethylene, propylene, and butadiene. Typical hydrocarbon feeds include, e.g., one or more of ethane and propane, naphtha, heavy gas oils, crude oil, etc. Steam cracking furnaces for carrying out steam cracking generally include a convection section, a radiant section located downstream of the convection section, and a quenching stage located downstream of the radiant section. Typically, at least one burner is included in the steam cracking furnace for providing heat to the convection and radiant sections. The burners are typically located in at least one firebox, the firebox being proximate to the radiant section, with the convection section being located downstream of the radiant section with respect to the flow of heated gases (typically combustion gases) produced by the burner. Tubular coils are utilized for conveying the hydrocarbon feed, steam, and mixtures thereof through the furnace's convection and radiant sections.

At the start of the process, a hydrocarbon feed is introduced into one or more of the convection section's tubular coils (the "convection coils"). The convection coils' external surfaces are exposed to the heated gases conducted away from the burner. Heat is indirectly transferred from the heated gases to the hydrocarbon feed for preheating the hydrocarbon feed. Steam is combined with the pre-heated hydrocarbon feed to produce a hydrocarbon+steam mixture. Additional convection coils are utilized for pre-heating the hydrocarbon+steam mixture, e.g., to a temperature at or just below the temperature at which significant thermal cracking occurs.

The preheated hydrocarbon+steam mixture is conducted via cross-over piping from the convection coils to the radiant coils. The radiant coils are located proximate to the burner, typically within the firebox. The preheated hydrocarbon+steam mixture is indirectly heated in the radiant coils, primarily by the transfer of heat from the burner to the radiant coils' exterior surface, e.g., radiant heat transfer from flames produced in one or more burners located in the firebox, radiant heat transfer from the interior surfaces of the firebox enclosure, convective heat transfer from combustion gases traversing the radiant section, etc.

Heat transferred to the preheated hydrocarbon+steam mixture in the radiant coils results in thermal cracking of at least a portion of the mixture's hydrocarbon to produce a radiant coil effluent comprising light olefin, unreacted steam, and unreacted hydrocarbon feed. Transfer line piping is typically utilized for conveying radiant coil effluent from the radiant section to the quenching stage. When the hydrocarbon feed comprises heavy gas oil, the radiant coil effluent typically has a temperature at the radiant coil outlet (the Coil Outlet Temperature or "COT") of about 790° C. (1450° F.). For hydrocarbon feeds comprising ethane and/or propane, COT is typically about 900° C. (1650° F.).

Radiant coil effluent is conducted away from the radiant coil outlet for quenching in one or more quenching stages in order to halt the thermal cracking reaction. Quenching is typically carried out in close proximity to the radiant coils to lessen the formation of undesired thermal cracking byproducts. Quenching can be carried out by indirectly transferring heat away from the radiant coil effluent, e.g., using one or more heat exchangers (e.g., quench exchangers). Quench exchangers cool the radiant section against water, and produce quenched radiant coil effluent and high-pressure steam. Quench exchangers are beneficial because the high-pressure steam can be expanded in one or more steam-turbines to produce shaft power. The shaft power can be used for operating compressors, which are typically needed in light olefin separation and recovery stages located downstream of the quenching stage.

When the hydrocarbon feed comprises heavy crude oil and/or heavy gas oil, the radiant coil effluent typically comprises a significant amount of pyrolysis tar, e.g., steam cracker tar ("SCT"). It has been observed that SCT deposits foul internal surfaces of quench exchangers, which lessens the amount of indirect heat transfer from the radiant coil effluent, resulting in less than the desired amount of quenching.

In order to overcome this difficulty, heat is directly transferred from the radiant coil effluent, e.g., by contacting the radiant coil effluent with a hydrocarbon, typically an oil ("quench oil"), having a temperature lower than that of the radiant coil effluent. Quenching can be carried out by directly injecting quench oil into the radiant coil effluent, e.g., by injecting quench oil into a segment of the transfer line piping located in the quenching stage.

Quench oil injection leads to a rapid cooling of the radiant coil effluent, resulting primarily from quench oil vaporization in the quenching stage. A quenched product mixture, comprising radiant coil effluent and vaporized quench oil, is conducted away from the quench stage to one or more separation and recovery stages, e.g., for separating and recovering light olefin from the quenched product mixture. Quench oil can be separated from the quenched product mixture for recycle and re-use in the quenching stage.

Coke is an undesirable byproduct of steam cracking, which forms on internal coil surfaces of the steam cracking furnace, e.g., on the radiant coils' internal surfaces. The presence of coke lessens heat transfer to the preheated hydrocarbon/steam mixture in the radiant coils, which results in less than the desired amount of thermal cracking. The presence of coke can also lead to undesirable changes in radiant coil composition, e.g., as a result of carburization, leading to radiant coil deterioration. Accordingly, it is desirable to remove coke from one or more of the furnace coils during periodic "decoking" modes, during which at least some of the furnace's coils (e.g., all of the furnace's radiant coils) are designated for decoking.

Furnace coil decoking during decoking mode typically includes (i) substituting a flow of air for the flow of hydrocarbon feed to the convection coils, (ii) adjusting the flow of steam to the convection coils and combining the air with the steam to produce a preheated air-steam mixture, (iii) passing the pre-heated air/steam decoking mixture through the cross-over piping from the convection coils to the radiant coils, (iv) substituting a flow of quench water for the flow of quench oil into the quenching stage, and (v) contacting decoking effluent exiting from the radiant coils with the quench water in the quenching stage to quench the decoking effluent. A quenched decoking effluent, comprising decoking effluent and vaporized quench water, is conducted away from the quenching stage, e.g., to one or more decoking separation stages (rather than to the quenched product mixture separation and recovery stages).

Decoking is net exothermic. Additional heat is added to those furnace tubes undergoing decoking. The combination of decoking reaction heat and furnace heat can lead to overheating of furnace components, resulting in damage to the quenching and decoking separation stages during decoking. It is conventional to lessen the effects of overheating during decoking by regulating the amount of quench water injected into the decoking effluent. More particularly, it is desired to regulate temperature in the transfer line piping located downstream of decoking effluent quenching and in piping within the decoking separation stage to a temperature $\leq T_{max}$. $T_{max}$ is approximately 840° F. (about 450° C.) when carbon steel piping is utilized in these locations. Quench water flow rate is increased, maintained, or lessened in response to temperature measured at one or more locations in quenching stage conduits and in decoking separation stage conduits, in order to achieve the temperature desired for the transfer line piping located downstream of decoking effluent quenching.

Difficulties have been encountered when regulating the flow of quench water into the quenching stage, resulting in a loss of temperature control and the potential for exceeding $T_{max}$. It is desired to overcome these difficulties.

SUMMARY OF INVENTION

Certain decoking conditions undesirably lead to stratified quench water flow in quenching stage conduits located downstream of quench water injection and/or in decoking separation stage conduits. It has been found that stratified flow results from incomplete mixing of the quench water and decoking effluent. It has also been found that quench water stratification results in a significant temperature gradient traversing the perimeter (internal and external) of transfer line piping downstream of decoking effluent quenching.

The invention is based in part on the discovery that difficulties arising from quench water stratification can be lessened or substantially overcome by employing two-stage quenching during decoking. The first quench stage utilizes a first aqueous quench medium, which is primarily in the liquid phase. The second quench stage utilizes a second aqueous quench medium, which is primarily in the vapor phase. When carrying out decoking effluent quenching in the first quench stage, first aqueous quench medium in introduced into the decoking effluent. Heat is transferred from the decoking effluent to the first aqueous quench medium to vaporize substantially all of the first aqueous quench medium. This produces a partially-quenched decoking effluent, comprising cooled decoking effluent and vaporized first aqueous quench medium. In the second quench stage, which is located downstream of the first quench stage, the second aqueous quench medium is introduced into the partially-quenched decoking effluent. Heat is transferred to the second aqueous quench medium from the partially-quenched decoking effluent to cool partially-quenched decoking effluent. This produces a quenched decoking effluent having a desired temperature, e.g., a temperature $\leq T_{max}$. The quenched decoking effluent comprises the decoking effluent, the first aqueous quench medium, and the second aqueous quench medium.

Accordingly, certain aspects of the invention relate to a process and system for removing coke formed during steam cracking of a hydrocarbon feed in a furnace having a firebox, radiant coils, and at least one oil quench connection through which liquid quench oil is injected into a radiant coil effluent to directly cool the radiant coil effluent. The process and system each comprise: (a) terminating the flow of hydrocarbon feed to the furnace; (b) terminating the flow of quench oil to the oil quench connection; (c) supplying a decoking feed comprising steam and air to the furnace under conditions sufficient to at least partially combust coke accumulated on the radiant coils to form a decoking effluent; (d) providing first and second quench media, the first aqueous quench medium being primarily liquid phase and the second aqueous quench medium being primarily vapor phase; (e) introducing the first aqueous quench medium into the decoking effluent to produce a partially quenched decoking effluent that is substantially all vapor phase; and (f) introducing the second aqueous quench medium into the partially quenched decoking effluent to produce a quenched decoking effluent that is substantially all vapor phase.

In other aspects, the invention relates to a process and system for quenching a decoking effluent from a hydrocarbon pyrolysis furnace. The process comprises (a) providing a primarily vapor-phase decoking effluent, the decoking effluent comprising air, superheated steam, and decoking products; (b) providing first and second quench media, the first aqueous quench medium being primarily liquid phase and the second aqueous quench medium being primarily vapor phase; (c) introducing the first aqueous quench medium into the decoking effluent; (d) partially quenching the decoking effluent, wherein the partial quenching includes transferring heat from the decoking effluent to the first aqueous quench medium, vaporizing substantially all of the liquid-phase portion of the first aqueous quench medium, and maintaining in the vapor phase substantially all of the vapor-phase portion of the decoking effluent; and (e) introducing the second aqueous quench medium into the partially-quenched decoking effluent; and (f) quenching the partially-quenched decoking effluent, wherein the quenching includes transferring heat from the partially-quenched decoking effluent to the second aqueous quench medium and maintaining in the vapor phase (i) substantially all of the vaporized first aqueous quench medium, (ii) substantially all of the vapor-phase portion of the second aqueous quench medium, and (iii) the vapor-phase portion of the decoking effluent.

In other aspects, the invention relates to an apparatus for hydrocarbon pyrolysis, the apparatus comprising: (a) at least one pyrolysis furnace, (b) an inlet for providing hydrocarbon feed to the furnace, the furnace being operable to pyrolyse the hydrocarbon feed, (c) an outlet for removing pyrolysis effluent from the pyrolysis furnace, (d) a first quench stage to cool the pyrolysis effluent and configured to provide a liquid quench medium, and (e) a second quench stage to further cool the pyrolysis effluent, said second quench stage located downstream of said first quench stage and configured to provide a gaseous quench medium.

BRIEF DESCRIPTION OF THE DRAWING

The invention is further explained in the description that follows with reference to the drawing which illustrates, by way of non-limiting examples, various embodiments of the invention wherein:

FIG. 1 illustrates a schematic flow diagram of a pyrolysis furnace having a quenching stage suitable for use with two-stage quenching during decoking.

DETAILED DESCRIPTION

During stratified flow, a major portion of the conduit's internal surface area (e.g., ≥60%, such as ≥75%, or ≥90%) contains a vapor-phase composition with little or no liquid; and a minor portion of the conduit's internal surface area (typically ≤40%, e.g., ≤25%, such as 10%) contains a liquid-phase composition, with little or no vapor. It is observed that the vapor-phase composition comprises primarily incompletely quenched decoking effluent and the liquid phase composition comprises primarily quench water. In substantially horizontal conduits of the decoking separation stage, the liquid phase is observed to flow in the bottom portion of the conduit's cross sectional area, with the vapor-phase composition flowing above, in an upper portion of the conduit's cross sectional area.

The stratified flow results from incomplete mixing of the quench water and decoking effluent, with the incomplete mixing primarily arising from two factors: quench water misdistribution in the decoking effluent and low velocity of the decoking effluent during and after quench water introduction. Incomplete mixing of decoking effluent and quench water results in less than the desired amount of decoking effluent quenching. Quench water atomization results in exposing a significant quench water surface area to the decoking effluent, leading to an efficient direct transfer of heat (quenching) from the decoking effluent to the atomized quench water and large quench water vaporization rate. Once stratified flow occurs, less quench water surface area is exposed to the decoking effluent, which leads to inefficient heat transfer from the decoking effluent to the stratified quench water and, consequently, a smaller vaporization rate for the stratified quench water.

It is observed that quench water stratification leads to a significant temperature gradient traversing the perimeter (internal and external) of transfer line piping downstream of decoking effluent quenching. That segment of the internal perimeter exposed to flow of the vapor-phase composition at a particular piping location exhibits a much higher temperature than does the remainder of perimeter, which is exposed to the liquid-phase composition. This can lead to piping failure and flange leakage, e.g., as a result of thermal stress arising from the temperature gradient and temperature gradient variations over time. The thermal gradients and thermal gradient variations are also observed to worsen quench water flow rate control, as a result of differences reported by temperature sensors located in regions of the piping exposed to stratified quench water flow (lower reported temperature) and temperature sensors located in regions of the piping exposed to vapor-phase flow of incompletely quenched decoking effluent (much higher reported temperature). Cycling of the reported temperature, as can occur when the surface of stratified quench liquid covers and then uncovers a temperature sensor in response to increased and then decreased quench water injection rate, can lead to an even more rapid cycling of quench water injection rate. This can lead to a loss of quench water injection rate control, resulting in a further increase in the severity of thermal fatigue and a further decrease in pipework lifetime. The invention overcomes this difficulty by quenching the decoking effluent in at least two stage, wherein (i) the first stage utilizing an first aqueous quench medium that is primarily in the liquid phase and (ii) the second quench stage utilizes a second aqueous quench medium that is primarily in the vapor phase. For the purpose of this description and appended claims, the following terms are defined.

Definitions

For the purpose of this description and appended claims, the flowing terms are defined.

"Hydrocarbon feed" means any feed which comprises hydrocarbon and is suitable for producing $C_{2+}$ unsaturated hydrocarbon by pyrolysis, such as by steam cracking. Typical hydrocarbon feeds comprise ≥10% hydrocarbon (weight basis, based on the weight of the hydrocarbon feed), e.g., ≥50%, such as ≥90%, or ≥95%, or ≥99%.

"Decoking effluent" means unquenched decoking effluent from those regions of a pyrolysis furnace designated for decoking, typically unquenched decoking effluent from steam cracking furnace radiant coils which are operating in decoking mode.

"First aqueous quench medium" refers to an aqueous quench medium, e.g., water, that is at a temperature and pressure sufficient to provide the medium in a liquid phase to a quenching stage. When substantially all of the first aqueous quench medium is provided in the liquid phase, it is referred to as a "liquid quench medium".

"Second aqueous quench medium" refers to an aqueous quench medium, e.g., water, that is at a temperature and pressure sufficient to provide the medium in a gaseous state to a quenching stage. When substantially all of the second aqueous quench medium is provided in a gaseous state, it is referred to as a "gaseous quench medium".

As used herein the phrase "substantially free" of a specified component of a composition means that the component is present in the composition in an amount ≤1 vol %, e.g. ≤0.5 vol %, ≤0.1 vol %, ≤0.01 vol %, ≤0.005 vol %, or in an amount that is below detection limit of the detection method.

Various aspects will now be described with reference to specific embodiments selected for purposes of illustration. It will be appreciated that the spirit and scope of the process and system disclosed herein is not limited to the selected embodiments. Moreover, it is to be noted that the FIGURE is not depicted in any particular proportion or scale, and that many variations can be made to the illustrated embodiments. When an amount, concentration, or other value or parameter is given as a list of upper preferable values and lower preferable values, this is to be understood as specifically disclosing all ranges formed from any pair of an upper preferred value and a lower preferred value, regardless whether ranges are separately disclosed.

Decoking a Hydrocarbon Pyrolysis Furnace

Certain aspects of the invention relate to decoking a hydrocarbon pyrolysis furnace. In particular aspects, the invention relates to lessening or substantially preventing stratification of a quench medium such as water during pyrolysis effluent quenching. Typically, the pyrolysis furnace is operated in pyrolysis mode for a first time interval, during which a hydrocarbon feed is thermally cracked (pyrolysed), optionally in the presence of steam. Conventional hydrocarbon pyrolysis conditions and feeds can be used, but the invention is not limited thereto. Coke accumulates in one or more regions of the pyrolysis furnace during the first interval, typically as a byproduct of the pyrolysis. Accumulated coke can be removed by decoking during a second time interval by operating in decoking mode those regions of the pyrolysis furnace designated for decoking. Decoking typically includes flowing a mixture of steam and air through the designated regions. The mixture typically removes coke, e.g., by one or more of desorption (chemical and/or physical), ablation (including, e.g., one or more of abrasion, erosion, chipping, peeling, vaporization, and evaporation), and reaction (including, e.g., one or more of combustion, partial combustion, and hydrogen transfer), etc. The invention is not limited to any particular coke-removal mechanism. Conventional pyrolysis furnace decoking conditions and decoking feeds (e.g., a mixture of steam and air) can be used, but the invention is not limited thereto. A decoking effluent is conducted away from the pyrolysis furnace for quenching. The decoking effluent is primarily vapor phase at the start of quenching. It is within the scope of the invention for decoking effluent to further comprise liquid and/or solid components, e.g., ablated coke particulates, products of decoking reactions, desorbed coke and desorbed decoking products, etc. The amount of liquid phase and solid phase coke components is typically small, e.g., ≤10% (wt. bases, based on the weight of the decoking effluent), such as ≤5%, or ≤1%, or ≤0.1%. Typically, any liquid phase and/or solid phase decoking components are dispersed as particulates in the decoking effluent. Process conditions (e.g., the velocity of the decoking effluent) in the quenching stages and decoking separation stages are typically maintained to maintain any liquid and/or solid particulates in the dispersed state until it is convenient to remove them from the decoking effluent, generally in one or more of the decoking separation stage. The decoking effluent quenching can be operated so that (i) substantially all of the decoking effluent which enters the first quench stage as vapor typically remains in the vapor phase, (ii) substantially all of the first aqueous quench medium which is introduced as liquid is typically vaporized, and (iii) substantially all of the second aqueous quench medium which is introduced as vapor typically remains in the vapor phase. Certain aspects of the invention relate to quenching the decoking effluent in at least first and second quench stages, the first and second quench stages being located upstream of the decoking separation stages. The first and second quench stages will now be described in more detail.

The first quench stage utilizes a first aqueous quench medium, which is primarily in the liquid phase, e.g., ≥90% (vol. basis) of the first aqueous quench medium is in the liquid phase at the start of first-stage quenching, such as ≥95%, or ≥99%, or ≥99.9%. All (or substantially all) of the first aqueous quench medium, can be in the liquid phase at the start of first-stage quenching. The first aqueous quench medium can be an aqueous composition, e.g., water. The second quench stage utilizes a second aqueous quench medium, which is primarily in the vapor phase; e.g., ≥90% (vol. basis) of the second aqueous quench medium is in the vapor phase at the start of second-stage quenching, such as ≥95%, or ≥99%, or ≥99.9%. All (or substantially all) of the second aqueous quench medium, can be in the vapor phase at the start of second-stage quenching. The second aqueous quench medium is typically a vapor-phase aqueous composition, e.g., steam, such as superheated steam.

First-stage quenching begins by combining the first aqueous quench medium with the decoking effluent, e.g., by injecting the first aqueous quench medium into the decoking effluent. Heat is transferred from the decoking effluent to the first aqueous quench medium which vaporizes the first aqueous quench medium and cools the decoking effluent Typically, the first quench results in vaporization of ≥90% (vol. basis) of that portion of the first aqueous quench medium which is in the liquid phase when it is combined with the decoking effluent, e.g., ≥95%, such as ≥99%, or ≥99.9%. Typically, all (or substantially all) of the first aqueous quench medium is vaporized during the first-stage quenching. The first-stage quenching produces a partially-quenched decoking effluent, comprising cooled decoking effluent and vaporized first aqueous quench medium, which is conducted to the second quench stage. Typically ≥90% (vol. basis) of the partially-quenched decoking effluent exits the first quench stage in the vapor phase, e.g., ≥95%, such as ≥99%, or ≥99.9%. Typically, all or substantially all of the decoking effluent which enters the first quench stage in the vapor phase remains in the vapor phase during the first-stage quenching.

Second stage quenching begins by combining the second aqueous quench medium and the partially-quenched decoking effluent. Heat is transferred to the second aqueous quench medium from the partially-quenched decoking effluent to produce a quenched decoking effluent having a desired temperature, e.g., a temperature $\leq T_{max}$. The invention is compatible with a small amount of first aqueous quench medium exiting the first quench stage in the liquid phase. All or substantially all of the first aqueous quench medium exiting the first quench stage in the liquid phase is typically vaporized in the second quench stage. $T_{max}$ typically depends on the compositions and structure of components (e.g., conduit, such as piping) in the decoking separation stage. When such components include carbon steel piping, $T_{max}$ is approximately 840° F. (about 450° C.). The invention is not limited to any particular $T_{max}$, and $T_{max}$ can be, e.g., ≤600° C., such as ≤550° C., or ≤500° C., or ≤450° C., or ≤400° C., or ≤350° C. In certain aspects, $T_{max}$ is in the range of from 350° C. to 500° C.

The quenched decoking effluent comprises the decoking effluent, the first aqueous quench medium, and the second aqueous quench medium. Typically ≥90% (vol. basis) of the quenched decoking effluent exits the second quench stage in the vapor phase, e.g., ≥95%, such as ≥99%, or ≥99.9%, or substantially all. Typically, ≥90% (vol. basis), e.g., ≥95.0%, such as ≥99%, or ≥99.9%, or substantially all, or all of the decoking effluent which enters the first decoking stage as vapor exits the second decoking stage as vapor. Typically, ≥90% (vol. basis), e.g., ≥95%, such as ≥99%, or ≥99.9%, or substantially all, or all of the first aqueous quench medium which is introduced into the first quench stage as liquid exits the first quench stage as vapor. Typically, ≥90% (vol. basis), e.g., ≥95.0%, such as ≥99%, or ≥99.9%, or substantially all, or all of the second aqueous quench medium which is introduced into the second quench stage as vapor exits the second quench stage in the vapor phase. Quenched decoking effluent exiting the second quench stage is typically conducted to one or more decoking separation stages. For example, a decoking separation stage can be used for separating particulates from the quenched decoking effluent.

The invention is not limited to any particular kind of pyrolysis. In the following description, aspects of the invention are described in connection with steam cracking. The invention is not limited to these aspects, and this description is not meant to foreclose other aspects within the broader scope of the invention, such as those which include pyrolysing hydrocarbon without steam.

Decoking a Steam Cracking Furnace

Referring now to FIG. 1, a steam cracking furnace 1 includes a radiant firebox 103, a convection section 104 and flue gas exhaust 105. Fuel gas is provided via conduit 100 and control valve 101 to burners 102 that provide radiant heat to a hydrocarbon feed to produce the desired pyrolysis products by thermal cracking of the feed. The burners generate hot gas that flows upward through the convection section 104 and then away from the furnace via conduit 105.

Hydrocarbon feed is conducted via conduit 10 and valve 12 to a first bank of convection coils. Hydrocarbon feed introduced into convection coil 13 is preheated by indirect contact with hot flue gas. Valve 12 is used to regulating the amount of hydrocarbon feed introduced into convection coils 13. Convection coil 13 is typically one of a plurality of convection coils that are arranged in a first coil bank for parallel hydrocarbon feed flow. Typically, a plurality of feed conduits 10, 11 convey hydrocarbon feed to each of the parallel convection coils of the first tube bank. Four feed conduits are represented in FIG. 1, but the invention is not limited to any particular number of feed conduits. For example, the invention is compatible with convection sections having 3, 4, 6, 8, 10, 12, 16, or 18 feed conduits for conveying in parallel portions of a total hydrocarbon feed to an equivalent number of convection coils located in the first coil bank. Although not shown, each of the plurality of feed conduits 11 may be provided with a valve (similar to valve 12). In other words, each of the plurality of conduits 11 is in fluid communication with a convection coil (not shown) operating in parallel with convection coil 13. For simplicity, the description of the first convection coil bank will focus on coil 13. The other convection coils in the bank operate in a similar manner.

Dilution steam is provided via dilution steam conduit 20 through valve 22 to convection coil 23 for preheating by indirect transfer of heat from flue gas. Valve 22 is used for regulating the amount of dilution steam introduced into convection coils 23. Convection coil 23 is typically one of a plurality of convection coils that are arranged in a second coil bank for parallel dilution steam flow. Typically, a plurality of dilution steam conduits 20, and 21 convey dilution steam to each of the parallel convection coils of the second tube bank. Four dilution steam conduits are represented in FIG. 1, but the invention is not limited to any particular number of dilution steam conduits. For example, the invention is compatible with convection sections having 3, 4, 6, 8, 10, 12, 16, or 18 dilution steam conduits for conveying in parallel portions of an amount of total dilution steam to an equivalent number of convection coils located in the second convection coil bank. Although not shown, each of the plurality of dilution steam conduits 21 may be provided with a valve (similar to valve 22). In other words, each of the plurality of conduits 21 is in fluid communication with a convection coil (not shown) operating in parallel with convection coil 23. For simplicity, the description of the second convection coil bank will focus on coil 23. The other convection coils in the bank operate in a similar manner.

Preheated dilution steam and preheated hydrocarbon feed are combined in or proximate to conduit 25. The hydrocarbon+steam mixture is reintroduced into convection section 104 via conduit(s) 25, for preheating of the hydrocarbon+steam mixture in convection coil 30 of a third convection section tube bank. Convection coil 30 is typically one of a plurality of convection coils that arranged in the third bank for parallel flow of the hydrocarbon+steam mixture. One such convection coil is represented in FIG. 1, but the invention is not limited to any particular number of these convection coils. For example, the invention is compatible with a third coil bank having 3, 4, 6, 8, 10, 12, 16, or 18 convection coils for conveying in parallel portions of an amount of total hydrocarbon+steam mixture. For simplicity, the description of the third convection coil bank will focus on coil 30. The other convection coils in the bank operate in a similar manner. The hydrocarbon+steam mixture is typically preheated in convection coil 30, e.g., to a temperature in the range of from about 750° F. to about 1400° F. (400° C. to 760° C.).

Cross-over piping 31 is used for conveying preheated hydrocarbon+steam mixture to radiant coil 40 in radiant section 103 for thermal cracking of the hydrocarbon. Radiant coil 40 is typically one of a plurality of radiant coils (the others are not shown), which together constitute a bank of radiant coils in radiant section 103. The temperature of the heated mixture exiting conduit 30 is generally designed to be at or near the point where significant thermal cracking commences. Process conditions such as the amount of feed pre-heating in convection coil 13, the amount of steam pre-heating in convection coil 23, the amount of hydrocarbon+steam mixture pre-heating in convection coil 30, the relative amount of hydrocarbon feed and dilution steam, the temperature, pressure, and residence time of the preheated hydrocarbon+steam mixture in radiant coil 40, and the duration of the first time interval (the duration of pyrolysis mode in coils 13, 23, 30, and 40) typically depend on the composition of the hydrocarbon feed, yields of desired products, and the amount of coke accumulation in the furnace (particularly in radiant coils) that can be tolerated. Certain hydrocarbon feeds and process conditions used for steam cracking those feeds will now be described in more detail. The invention is not limited to these feeds and process conditions, and this description is not meant to foreclose other feeds and/or process conditions within the broader scope of the invention.

Hydrocarbon Feeds

In certain aspects, the hydrocarbon feed comprises relatively high molecular weight hydrocarbons ("Heavy Feedstocks"), such as those which produce a relatively large amount of SCT during steam cracking. Examples of Heavy Feedstocks include one or more of steam cracked gas oil and residues, gas oils, heating oil, jet fuel, diesel, kerosene, coker naphtha, steam cracked naphtha, catalytically cracked naphtha, hydrocrackate, reformate, raffinate reformate, Fischer-Tropsch liquids, Fischer-Tropsch gases, distillate, crude oil, atmospheric pipestill bottoms, vacuum pipestill streams including bottoms, gas oil condensates, heavy non-virgin hydrocarbon streams from refineries, vacuum gas oils, heavy gas oil, naphtha contaminated with crude, atmospheric residue, heavy residue, $C_4$/residue admixture, naphtha/residue admixture, gas oil/residue admixture, and crude oil. The hydrocarbon feed can have a nominal final boiling point of at least about 600° F. (315° C.), generally greater than about 750° F. (399° C.), typically greater than about 850° F. (454° C.), for example greater than about 950° F. (510° C.). Nominal final boiling point means the temperature at which 99.5 weight percent of a particular sample has reached its boiling point.

Optionally, e.g., when the hydrocarbon feed comprises certain Heavy Feedstocks, the steam cracking furnace has at least one vapor/liquid separation device (sometimes referred to as flash pot or flash drum) integrated therewith. When used, the vapor-liquid separator is configured for upgrading the hydrocarbon feed (e.g., by upgrading the hydrocarbon+ steam mixture and/or preheated hydrocarbon+steam mixture) upstream of the steam cracking furnace's radiant section. It can be desirable to integrate a vapor-liquid separator with the furnace when the hydrocarbon feed comprises ≥1.0 wt. % of non-volatiles, e.g., ≥5.0 wt. %, such as 5.0 wt. % to 50.0 wt. % of non-volatiles having a nominal boiling point ≥1400° F. (760° C.). It is particularly desirable to integrate a vapor/liquid separator with the pyrolysis furnace when the non-volatiles comprise asphaltenes, such as pyrolysis feedstock's hydrocarbon comprises ≥about 0.1 wt. % asphaltenes based on the weight of the pyrolysis feedstock's hydrocarbon component, e.g., ≥about 5.0 wt. %. Conventional vapor/liquid separation devices can be utilized to do this, though the invention is not limited thereto. Examples of such conventional vapor/liquid separation devices include those disclosed in U.S. Pat. Nos. 7,138,047; 7,090,765; 7,097,758; 7,820,035; 7,311,746; 7,220,887; 7,244,871; 7,247,765; 7,351,872; 7,297,833; 7,488,459; 7,312,371; 6,632,351; 7,578,929; and 7,235,705, which are incorporated by reference herein in their entirety. Typically, a vapor phase is separated from the hydrocarbon feed in the vapor/liquid separation device. The separated vapor phase is conducted away from the vapor/liquid separator to the radian coils for pyrolysis. The liquid-phase separated from the hydrocarbon feed can be conducted away from the vapor/liquid separation device, e.g., for storage and/or further processing.

In other aspects, the hydrocarbon feed comprises one or more relatively low molecular weight hydrocarbon (Light Feedstocks), particularly those aspects where relatively high yields of $C_2$ unsaturates (ethylene and acetylene) are desired. Light Feedstocks typically include substantially saturated hydrocarbon molecules having fewer than five carbon atoms, e.g., ethane, propane, and mixtures thereof (e.g., ethane-propane mixtures or "E/P" mix). For ethane cracking, a concentration of at least 75% by weight of ethane is typical. For E/P mix, a concentration of at least 75% by weight of ethane plus propane is typical, the amount of ethane in the E/P mix being ≥20.0 wt. % based on the weight of the E/P mix, e.g., in the range of about 25.0 wt. % to about 75.0 wt. %. The amount of propane in the E/P mix can be, e.g., ≥20.0 wt. %, based on the weight of the E/P mix, such as in the range of about 25.0 wt. % to about 75.0 wt. %.

Steam Cracking Process Conditions

The preheated hydrocarbon+steam mixture is conveyed via cross-over piping 31 to radiant coil 40 located in the furnace's radiant section 103. A typical steam cracking furnace comprises a plurality of radiant coils, e.g., radiant coil 40 and at least a second radiant coil (not shown) arranged in parallel with radiant coil 40. The plurality of radiant coils can be arranged in groups, with each radiant coil in a group receiving a portion of the total preheated hydrocarbon+steam mixture fed to that group.

In certain aspects, the hydrocarbon+steam mixture comprises steam in an amount in the range of from 10.0 wt. % to 90.0 wt. %, based on the weight of the hydrocarbon+steam mixture, with the remainder of the hydrocarbon+steam mixture comprising (or consisting essentially of, or consisting of) the hydrocarbon feed. In certain aspects, the hydrocarbon+steam mixture is produced by combining the preheated hydrocarbon exiting convection coil 13 with the preheated steam exiting convection coil 23, e.g., at a ratio of 0.1 to 1.0 kg steam per kg hydrocarbon, or a ratio of 0.2 to 0.6 kg steam per kg hydrocarbon.

Suitable steam cracking conditions include, e.g., exposing the hydrocarbon+steam mixture to a temperature (measured at the radiant outlet) ≥400° C., e.g., in the range of 400° C. to 900° C., and a pressure ≥0.1 bar, for a cracking residence time in the range of from about 0.01 second to 5.0 second.

In certain aspects, the hydrocarbon feed comprises, consists essentially of, or consists of Heavy Feedstock, and the hydrocarbon+steam mixture comprises 0.2 to 1.0 kg steam per kg hydrocarbon. In these aspects, the steam cracking conditions generally include one or more of (i) a temperature in the range of 760° C. to 880° C.; (ii) a pressure in the range of from 1.0 to 5.0 bar (absolute), or (iii) a cracking residence time in the range of from 0.10 to 2.0 seconds. The effluent of radiant coil 40 typically has a temperature in the range of about 760° C. to 880° C., e.g., about 790° C. (1450° F.).

In other aspects, the hydrocarbon feed comprises, consists essentially of, or consists of Light Feedstock, and the hydrocarbon+steam mixture comprises 0.2 to 0.5 kg steam per kg hydrocarbon. In these aspects, the steam cracking conditions generally include one or more of (i) a temperature in the range of about 760° C. to 1100° C.; (ii) a pressure in the range of from 1.0 to 5.0 bar (absolute), or (iii) a cracking residence time in the range of from 0.10 to 2.0 seconds. The effluent of radiant coil 40 typically has a temperature in the range of about 760° C. to 1100° C., e.g., about 900° C. (1650° F.) for ethane or propane feeds.

After the desired degree of thermal cracking has been achieved in the radiant section 103, the furnace effluent is rapidly cooled. For this purpose, quench oil is injected into the radiant coil effluent via at least one direct oil quench fitting located in quenching stage 60. Additional quenching stages can be utilized in parallel with stage 60, with a radiant coil (or group of radiant coils) providing a portion of a total radiant coil effluent to each of the plurality of parallel quenching stages. For simplicity, radiant coil effluent quenching is described with respect to a single radiant coil 40 feeding a single quench zone 60, but the invention is not limited to this aspect. The addition of quench oil into the furnace effluent stream provides heat transfer from the radiant coil effluent directly to the injected quench oil. Typically, the radiant coil effluent is cooled primarily by the vaporization of the injected quench oil.

A problem with direct oil quench connections is the tendency to cause rapid plugging when the relatively cold quench oil contacts the hot radiant coil effluent. Specialized fittings for quench oil injection into quenching stage 60 in a manner that does not cause rapid plugging. Non-limiting examples of oil quench fitting designs that are incorporated here by reference in their entirety may be found in U.S. Pat. Nos. 8,177,200; 3,593,968; 6,626,424; 3,907,661; 4,444,697; 3,959,420; 5,061,408; and 3,758,081. For example, a quench fitting can include one or more spray nozzles. In another example, the quench oil is added in a manner to form a continuous liquid film on a cylindrical wall of the quench fitting. Still other examples add the quench oil through a single port in the quench fitting. Yet another example adds oil through a grooved circumferential slot in the quench fitting so as to create liquid film along the wall of the fitting. Another non-limiting example adds oil through a porous jacket into the furnace effluent stream.

The quench oil preferably comprises, consists of, or consists essentially of at least one distillate oil, e.g., at least one aromatic-containing distillate oil. One preferred aromatic oil has a final boiling point ≥400° C. (750° F.). Such aromatic quench oil can be obtained, e.g., by separation from quenched radiant-coil effluent stream 90. Conventional quench oil can be used, but the invention is not limited thereto. Quench oil is conducted to the quench fitting(s) of quench zone 60 via conduit 70 and valve 72. When a plurality of quench fittings is utilized, or, e.g., when a plurality of quench nozzles is utilized in a quench fitting, a plurality of quench oil conduits 71 may be provided for conveying appropriate portions of the quench oil to each fitting and/or nozzle.

Radiant coil effluent is conducted to quenching stage 60 via conduit 53. Sufficient quench oil 70 is directly combined with radiant coil effluent in quench zone 60 to ensure the temperature of the quenched radiant coil effluent 90 is appropriate for feeding downstream separation equipment. For example, a primary fractionator (not shown) can receive quenched radiant coil effluent having a temperature in the range of about 288° C. (550° F.) to 315° C. (600° F.). The quench oil is typically liquid phase when it is introduced into the quenching stage. The mass ratio of quench oil:hydrocarbon feed is typically in the range of about 2 to about 5, e.g., about 3 to about 5, such as about 3.25 to 3.75.

Regardless of the hydrocarbon feed being cracked, carbonaceous deposits ("coke") accumulate in one or more regions of the steam cracking, e.g., in radiant coils. Coke accumulates over time, and although it is an undesirable byproduct of hydrocarbon pyrolysis, its formation and accumulation is largely unavoidable. Besides the inner surfaces of the radiant coils, coke may accumulate in convection coils conveying hydrocarbon feed and/or hydrocarbon+steam mixture, in cross-over piping, and in the quenching zone, such as in one or more of direct oil-quench connections, fittings, and nozzles in the quenching zone.

When coke accumulates on the internal surfaces of the radiant tubes, the accumulated coke decreases the effective cross-sectional area of the tube, thereby necessitating higher pressures to maintain a constant throughput. Since coke is an effective insulator, its formation on tube walls is typically accompanied by an increase in furnace tube temperature to maintain cracking efficiency. High operating temperatures, however, result in a decrease in radiant coil lifetime, a decrease in yield of desired products (primarily as a result of less selective cracking which occurs at higher pressures), and an increase in coke accumulation rate. These effects lead to practical limits on the temperature to which a radiant coil can be exposed, and consequently lessen an operator's flexibility to overcome the undesirable effects of coke accumulation by increasing radiant coil temperature. In practice, at the start of pyrolysis mode, when radiant coil internal surface has little or no accumulated coke, the radiant coil exhibits a start-of-run temperature ("$T_{SOR}$"). As coke accumulates, the radiant coil temperature is increased (in response to increased firebox burners' caloric output) to a pre-determined end-of-run temperature ("$T_{EOR}$"). Coke accumulation can be observed directly or indirectly, e.g., as indicated by a greater pressure drop across the radiant coil or a lower temperature of the radiant coil effluent (at a substantially constant caloric output of the firebox burners). Radiant coil temperature is increased (e.g., by increasing firebox burner caloric output) until the radiant coil temperature is at or near $T_{EOR}$, at which point the radiant coil, and optionally the hydrocarbon+steam conduits (or vessels) feeding the radiant coil, is designated for decoking. The designated coils (and conduits/vessels) are then switched from pyrolysis mode to decoking mode.

Decoking is typically carried out by flowing a steam-air mixture through coils designated for decoking, while continuing operation of the burners (albeit at reduced caloric output). Typically, all of the coils in a furnace are decoked during a decoking interval (e.g., all are decoked during the same time interval). After sufficient decoking, the decoked furnace coils are switched from decoking mode to pyrolysis mode. Decoking can be repeated when an undesirable amount of coke again accumulates in the furnace's coils.

Decoking typically includes (i) substituting a flow of air for the flow of hydrocarbon feed to the convection coils, (ii) continuing a flow of steam to the convection coils and combining the air with the steam to produce a preheated air-steam mixture (steam flow rate can be greater than, substantially the same as, or less than the steam flow rate utilized during pyrolysis mode), (iii) passing the pre-heated air/steam decoking mixture through the cross-over piping from the convection coils to the radiant coils, and conducting decoking effluent away from the radiant coils. The decoking mode further includes (iv) substituting a flow of quench water to the first quench stage for the flow of quench oil. Heat is transferred from the decoking effluent to the quench water, which vaporizes the quench water and produces a partially-quenched decoking effluent. The decoking mode further includes (v) contacting the partially-quenched decoking effluent with quench steam in a second quench stage located downstream of the first quench stage to produce a quenched decoking effluent. The quenched decoking mixture is primarily vapor phase, but typically includes dispersed particulates and particulate products of decoking that may be solid and/or liquid. The quenched decoking effluent, which typically comprises the decoking effluent, the vaporized quench water, and the quenching steam, is conducted away from the second quench stage to one or more decoking separation stages (rather than to the quenched product mixture separation and recovery stages). Additional quenching stages can be utilized, e.g., a third quenching stage located downstream of the second quench stage and upstream of the decoking separation stages. Quenching stages for additional quenching of the quenched decoking effluent downstream of the second quench stage, when used, typically utilize steam as a quenching medium in order to maintain the quenched decoking effluent in the vapor phase and lessen the potential for stratification. The quenched decoking effluent is typically conducted away from quenching, e.g., for coke separation in a decoke cyclone or combustion in the furnace's firebox.

Referring again to FIG. 1, a decoking mode can be carried out in which convection coil 30, cross-over piping 31, and radiant coil 40 are all undergoing decoking decoking during a decoking interval. During this decoking mode, air is substituted for the hydrocarbon feed in feed conduit 10. The amount of air utilized for decoking can be regulated with valve 12. A flow of steam is maintained in conduit 20. The amount of steam utilized for decoking can be regulated using valve 22. Preheated air and preheated steam are combined in or proximate to conduit 25 to produce a decoking mixture. Decoking is carried out in convection coil 30, cross-over piping 31, and radiant coil 40 to produce a decoking effluent, which is carried away via transfer line piping 53 to first quench stage 60. Decoking removes at least a portion of the coke deposits in convection coil 30, cross-over piping 31, and radiant coil 40, primarily by controlled combustion of accumulated coke. Decoking mode is continued for a decoking time interval until the amount of accumulated coke in the conduits undergoing decoking is at or less than a predetermined desired amount. The amount of accumulated coke remaining during decoking can be monitored directly or indirectly, e.g., as indicated by a lesser pressure drop across the radiant coil or a greater temperature of the decoking effluent compares to those at the start of decoking mode. After sufficient coke is removed, the decoked conduits are switched from decoking mode to pyrolysis mode.

During decoking mode, decoking effluent from radiant coils 40 is partially quenched in first quench stage 60. Typically, liquid water is used as the quench medium in the first quench stage. The flow of quench oil in conduit 70 to first quench stage 60 is halted via valve 72 during decoking mode. Quench water is introduced as liquid water into first quench stage 60, e.g., via conduit 80 and valve 82. Certain aspects utilize at least one quench fitting, e.g., a plurality of quench fittings, for introducing the quench water into the decoking effluent. A plurality of water conduits 81 may be provided, e.g., one for each quench fitting. The first quench stage typically contains means for dispersing quench water into the decoking effluent, e.g., one or more nozzles can be used for dispersing water droplets to produce a mist, through which the decoking effluent passes. Heat is transferred from the decoking effluent to the dispersed liquid quench water. The partially-quenched decoking effluent is then conducted to second quench stage 62. Typically, the nozzles of the first quench stage that are utilized for dispersing quench water during decoking mode are the same nozzles used for injecting quench oil during pyrolysis mode. Flow control means, e.g., valve means, are utilized for regulating the amount of quench water introduced into the first quench stage, illustrated schematically by valve 82. Switching means can be utilized for switching the furnace or furnace components, e.g., radiant coils, from pyrolysis mode to decoking mode, and vice versa. Typical switching means include flow control means (e.g., one or more valves) and optionally including one or more controllers for operating the valves under automated control, e.g., via computer control.

The amount of water needed for decoking effluent quenching is much less than the amount of quench oil needed for radiant coil effluent quenching. For example, in certain aspects 3 Mg/hr (1.0 Mg=$1.0\times10^6$ grams) of water is used during decoking effluent quenching compared to 40 Mg/hr of quench oil used during radiant coil effluent quenching. First quench stage quenching apparatus, e.g., first stage quench vessel or conduits, quench fittings, quench nozzles, etc. are typically designed to function with quench oil flow rates encountered during radiant coil effluent quenching. Quench water maldistribution occurs when a flow of quench water is introduced into the first quench stage that should be sufficient to completely quench the radiant coil effluent. The maldistribution leads to stratified flow in the transfer line piping 61 downstream of the first quench stage during decoking. During stratified flow, a major portion of the internal surface area of piping 61 (e.g., ≥60%, such as ≥75%, or ≥90%) contains a vapor-phase composition with little or no liquid; and a minor portion of the piping's internal surface area (typically ≤40%, e.g., ≤25%, such as ≤10%) contains a liquid-phase composition, with little or no vapor. It is observed that the vapor-phase composition comprises primarily incompletely quenched decoking effluent and the liquid phase composition comprises primarily quench water. This leads to uneven and variable temperature gradients around the pipe which, over time, can lead to thermal fatigue failures of the pipe and flange leaks.

The invention overcomes this difficulty by introducing an amount of quench water into the first quench stage that is less than the amount needed for complete quenching of the effluent. The amount of quench water introduced into the first quench stage is regulated, e.g., by valve means 82, so that substantially all or all of the quench water vaporizes as a result of heat transferred from the decoking effluent. Surprisingly, it has been found that even though introducing a lesser amount of quench water worsens quench water maldistribution in the first quench stage, the amount of stratification downstream of the first quench stage decreases. While not wishing to be bound by any theory or model, it is believed that this results from achieving a desirable balance between two competing effects: (i) quench water maldistribution, which increases as quench water rate decreases and (ii) quench water vaporization rate, which can increase even when maldistribution increases, provided the decoking effluent is at a sufficient temperature to enable sufficient heat transfer to the quench water. The partially-quenched decoking effluent exiting the first quench stage can then be completely quenched in a second quench stage, e.g., using a vapor-phase second aqueous quench medium, such as steam, to produce a quenched decoking effluent (fully quenched) with little or no stratification in the first quench stage, the second quench stage, and conduits/stage downstream of the second stage through which decoking effluent passes.

Utilizing a liquid quench medium, e.g., quench water, in a first quench stage followed by further quenching with a gaseous quench medium, e.g., steam, in a second quench stage, lessens or prevents stratified flow, provides improved decoking effluent temperature control. It also lessens mechanical fatigue of piping downstream of the second quench stage by maintain the temperature of the quenched decoking effluent at a temperature $\leq T_{max}$.

Typically, a sufficient amount of quench water is introduced into the first quench stage via one or more of conduits 80 and 81 to produce a partially-quenched decoking effluent in conduit 61 having a temperature in the range of about 425.0 to about 550.0° C. (about 800.0 to about 1000.0° F.), particularly about 480.0 to 510.0° C. (about 900.0 to about 950.0° F.). One of ordinary skill in the art will readily be able to determine the rate of quench water supply to the first quench stage for any particular aspect, e.g., by considering the flow rates and enthalpies of decoking air and decoking steam introduced into the steam cracking furnace, process conditions (e.g., temperature and pressure) in the furnace and in the first quench stage, the enthalpies of the decoking effluent and quench water in the first quench stage, etc. The amount of quench water can be controlled by valve means, illustrated schematically as valve 82.

Partially-quenched decoking effluent is conducted away from first quench stage 60 via transfer line piping 61 to second quench stage 62. A second aqueous quench medium, e.g., a gaseous quench medium, typically steam, is combined with the partially-quenched decoking effluent in the second quench stage. Steam can be introduced into the second quench stage at a plurality of locations in second quench stage 62, via one or more conduits 91. Additionally or alternatively, the gaseous quench medium, e.g., quench steam, may be provided to the partially-quenched effluent via conduit 110, valve 111, and conduit 112. Optionally the gaseous quench medium may be provided at two or more points downstream in the process after the formation of the partially-quenched effluent. Sufficient gaseous quench medium provides a quenched effluent having a temperature of about 370.0 to about 480.0° C. (about 700.0 to about 900.0° F.), particularly about 400.0 to about 455.0° C. (about 750.0 to 850.0° F.). The temperature of the partially-quenched effluent is typically ≥10° greater than the temperature of the quenched effluent, e.g., ≥25° greater, such as ≥50° greater, or ≥80° greater, or ≥90° greater. Where the gaseous quench medium is quench steam, the steam may be provided at a temperature of about 105.0 to about 150.0° C. (about 225.0 to about 300.0° F.). Again, one of ordinary skill in the art will readily be able determine second aqueous quench medium flow rate for any particular aspect, e.g., by considering the flow rates and enthalpies of decoking air and decoking steam introduced into the steam cracking furnace, process conditions (e.g., temperature and pressure) in the furnace and in the first quench stage, the amounts and enthalpies of the decoking effluent and quench water in the first quench stage, the temperature and flow rate of the partially-quenched decoking effluent, process conditions (e.g., temperature and pressure) in the second quench stage, the amounts and enthalpies of the partially-quenched decoking effluent and quench steam in the second quench stage, etc. The amount of quench steam introduced into the second quench stage can be controlled by valve means (not shown). The quench steam is typically superheated steam, but it can be advantageous to at least partially desuperheat the steam. Utilizing desuperheated steam (cooler than superheated steam) as the quench steam lessens the amount of quench steam needed in the second quench stage to produce the quenched decoking effluent. Consequently, quench steam velocity into the second quench stage is lessened, which leads to less erosion of piping and related equipment in and proximate to the second quench stage. Additional quenching can be carried out downstream of the second quench stage, if desired. For example, a third quench medium, typically vapor phase, e.g., steam, can be introduced into the quenched decoking effluent via conduit 110, valve 111, and conduit 112. When the third quench medium comprises, consists essentially of, or consists of a vapor-phase quench medium, such as steam, quench water stratification in transfer line piping 90 is lessened or substantially prevented.

Advantageously, because the two-stage quench system significantly reduces or eliminates stratified flow, variations in measured temperature are reduced. The result is tighter control of the decoking effluent temperature. Tighter control allows the targeted quenched decoking effluent temperature to be optimized and set closer to the upper metallurgical temperature limit of the downstream piping $T_{max}$. For example, the quenched decoking effluent temperature may be controlled to a temperature that is ≤50° C. of $T_{max}$, e.g., ≤40° C., such as 30° C. This provides a cost saving optimization by avoiding over quenching of the process effluent that can be realized, for example, in reduced quench steam demand.

Additionally, providing a quenched decoking effluent having reduced stratification, particularly comprising components only in the vapor phase, is especially well-suited, for example, when the decoking effluent is directed into the furnace firebox (connection not shown). In such applications, any liquid water entering the firebox would instantly vaporize with a corresponding rapid increase in volume that could damage the firebox insulation system.

EXAMPLES

Example 1 (Comparative)

In this comparative example, a system as depicted in FIG. 1 is employed, but without second quench stage 62, quench steam injection conduits 91, and third quench stage components 110, 111, and 113. Initially, the furnace is operated in pyrolysis mode. A Heavy Feedstock is conducted to convection section 104 via a plurality of feed conduits 10, and 11 at a rate of 15 kg/s (120 klb/hr). Steam is introduced into the furnace via a plurality of steam conduits 20 and 21, to produce a hydrocarbon+steam mixture in a plurality of conduits 25, the hydrocarbon+steam mixture comprising 0.2 to 0.5 kg steam per kg hydrocarbon. The hydrocarbon+steam mixture is thermally cracked in radiant section 103 in a plurality of radiant coils 40, with the radiant coil effluent conducted to quenching stage 60 via transfer line piping 53. The steam cracking conditions in the radiant coils include (i) a temperature in the range of 760° C. to 880° C.; (ii) a pressure in the range of from 1.0 to 5.0 bar (absolute), and (iii) a cracking residence time in the range of from 0.10 to 2.0 seconds. The effluent of radiant coils 40 has a temperature of about 790° C. (1450° F.). Quench oil is provided at a rate of 53 kg/s (420 klb/hr) to quenching stage 60 via a plurality of conduits 70 and 71, to cool the radiant coil effluent. Pyrolysis mode is continued until a radiant coil temperature of about $T_{EOR}$ is needed to maintain the desired radiant coil effluent temperature of 790° C. The furnace is then switched to decoking mode.

During decoking, a flow of decoking air is substituted for the Heavy Feedstock flow in feed conduit 10. A flow of decoking steam is introduced into the convection section via the plurality of lines 20 and 21. The decoking steam is obtained from the same source as the steam utilized during pyrolysis mode. The total rate of air flow to the convection section via the inlet conduits 10, and 11 is about 2.83 kg/sec (22.5 klb/hr). The total flow of steam to the convection section via the plurality of lines 20 and 21 is about 5.7 kg/s (45 klb/hr). The decoking air and the decoking steam are preheated in convection section 104, removed from the furnace, and are then combined to produce a decoking mixture. The decoking mixture is conveyed back to the convection section via the plurality of conduits 25. The decoking mixture flows through plurality of conduits 30 and plurality of conduits 40 to at least partially decoke those conduits. The caloric output of plurality of burners 102 is lessened during decoking mode. Decoking effluent entering transfer line piping 53 is observed to have a temperature at the start of decoking mode of about 871° C. (about 1600° F.). A flow of quench water, via a plurality of lines 80 and 81, is substituted for the flow of quench oil to quenching stage 60. The quench water is introduced into stage 60 at a temperature of 82° C. (180° F.) and a pressure of 11 bar (150 psig). Decoking separation stage piping (not shown) downstream of transfer line piping 90 has a $T_{max}$ of about 449° C. (840° F.). To avoid exceeding $T_{max}$ during variations in decoking conditions and temperature control system fluctuations, a quench water amount is determined for injection into quenching stage 60 via a plurality of lines 80 and 81 to produce a quenched decoking effluent having a temperature of about 316° C. (about 600° F.). Process conditions at the start of quenching in stage 60 include a pressure of 2 bar and a temperature of 871° C.).

The amount of quench water required to maintain a quenched decoking effluent temperature of 316° C. is approximated from the equation:

$$(\dot{m}_3+\dot{m}_2)h_{we}+\dot{m}_1h_{ae}=\dot{m}_1h_1+\dot{m}_2h_2+\dot{m}_3h_3 \quad (1)$$

where $\dot{m}_1$ is the rate at which decoking air is introduced into the convection section (2.83 kg/sec), $\dot{m}_2$ is the rate at which decoking steam is introduced into the convection section (5.7 kg/sec), $\dot{m}_3$ is the rate at which quench water is introduced into the convection (in kg/sec), $h_1$ is the enthalpy of decoking air under the quenching conditions of stage 60 (2 bar at 871° C.), $h_2$ is the enthalpy of decoking under the quenching conditions of stage 60 (2 bar at 871° C.), $h_3$ is the enthalpy of quenching water under conditions at which it is introduced into stage 60 (11 bar at 82° C.), $h_{ae}$ is the enthalpy of decoking air at the outlet of stage 60 (2 bar, 316° C.), and under the quenching conditions of stage 60, and $h_{we}$ is the enthalpy of steam at the outlet of stage 60 (2 bar, 316° C.). The enthalpies can be calculated by conventional methods, or can be obtained, e.g., from steam tables (e.g., steam tables in Engineering and Chemical Thermodynamics, M. D. Koretsky, John Wiley and Sons, 2004). The following enthalpy values are used:

$$h_1 = \frac{1214kj}{\text{kg}},\ h_2 = \frac{14316kj}{\text{kg}},\ h_3 = \frac{338kj}{\text{kg}},\ h_{ae} = \frac{596kj}{\text{kg}},\ \text{and}$$

$$h_{we} = \frac{3105kj}{\text{kg}}.$$

Using these values, equation 1 is solved for $\dot{m}_3$, which yields a value of $\dot{m}_3$=3.1 kg/s. It is surprisingly observed that when a rate of quench water of 3.1 kg/s is provided to stage 60 under the specified conditions, that the quenched decoking effluent exiting stage 60 is stratified. A periodic loss of temperature control is observed, with the quenched decoking effluent temperature periodically exceeding $T_{max}$.

Example 2 (Comparative)

Example 1 is repeated, except a flow of quenching steam is substituted for the quenching water to stage 60 during decoking mode. The quenching steam introduced into stage 60 is superheated steam at a temperature of 370° F. (188° C.) and a pressure of about 2 bar $$\left(\text{enthalpy } h_3 = \frac{2846kj}{\text{kg}}\right).$$

Solving equation 1 using this value for $h_3$ yields a quench steam rate $$\dot{m}_3 = 33.4\ \frac{\text{kg}}{\text{s}}.$$

Injecting superheated steam into stage 60 during decoking at a mass flow rate of 33.4 kg/s would result in significant erosion of stage 60 components (primarily piping erosion).

Example 3

Example 1 is repeated, except that (i) a lesser amount of quench water is introduced into first quench stage 60 to produce a partially-quenched decoking effluent and (ii) superheated steam $$\left(h_3 = \frac{2846kj}{\text{kg}}\right)$$

is introduced into the partially-quenched decoking effluent via a plurality of line 91 in second quench stage 62.

It is observed that when $\dot{m}_3$ is about 1.99 kg/s (about 15.8 klb/hr), the partially-quenched decoking effluent has a temperature in the range of about 482° C. to about 510° C. (about 900° F. to about 950° F.), with little or no stratification in quenching stage 60 and downstream thereof. Since there is no stratification, a much tighter temperature control is observed. Consequently, a temperature of 800° F. (427° C.) is specified for the quenched decoking effluent exiting the second quench stage 62. A temperature closer to $T_{max}$ is desirable because (i) it decreases the amount of quench fluid needed for quenching and (ii) it simplifies further processing of quenched decoking effluent, e.g., in the firebox of radiant section 103. It is observed that a quenched decoking effluent temperature of 427° C. in conduit 90 is achieved by injecting the quenching steam into stage 62 at a rate of 24.3 klb/hr (3.06 kg/s). This steam rate is more than one order of magnitude less than that of Example 2, and little or no piping erosion occurs in stage 62. Little or no stratified water occurs in stage 62 and in transfer line piping (e.g., conduit 90) downstream of stage 62.

Example 4

Example 3 is repeated except that the quenching steam is desuperheated before it is introduced into the partially-quenched decoking effluent in second quench stage 62. It is observed that when operating stage 62 at a pressure of 1.84 bar, the superheated quench steam can be desuperheated to a temperature of about 121° C. without condensing liquid water during the second stage quenching. Further, it is observed that using the specified desuperheated steam as the quench steam for stage 62, the quench steam mass flow rate can be decreased to 2.62 kg/sec (20.8 klb/hr) while maintaining a quenched decoking effluent temperature of 800° F. (427° C.). Decreasing the quenching steam mass flow rate results in even greater operating economy and a further lessening of the potential for piping erosion is stage 62.

The decoking process of any aspect of the invention, including those of Examples 3 and 4, can be carried out under process control. The process control can include specifying $\dot{m}_1$, $\dot{m}_2$, the temperatures and pressures at the inlet of first and second quench stages, the temperature of the partially-quenched decoking effluent exiting the first quench stage, and the temperature of the quenched decoking effluent exiting the second quench stage. One or more computers can be used for carrying out computer programs for determining $h_1$, $h_2$, $h_3$, $h_{ae}$, $h_{we}$, and the enthalpy of quench steam or desuperheated quench steam introduced into stage 62. At least one additional computer program can be carried out to determine the value of $\dot{m}_3$ needed to maintain the partially-quenched decoking effluent at a temperature in the range of about 482° C. to about 510° C. to prevent stratification. The additional computer program or further computer program(s) can be utilized for (i) measuring the quenched decoking effluent temperature at one or more locations downstream of stage 62, (ii) obtaining a difference between one or more of the measured temperatures (or an average thereof) and the desired quenched decoking effluent temperature (typically about of 800° F. (427° C.)) to produce a correction value, and regulating the amount of quenching steam or quenching desuperheated steam introduced into stage 62 in response to the correction value to achieve a measured quenched decoking effluent temperature (or an average thereof) that is within a predetermined tolerance of the desired quenched decoking effluent temperature. Conventional temperature measurement equipment can be used for measuring quenched decoking effluent temperature, e.g., one or more thermocouples, thermowells, etc. Conventional technology can be used for conveying the measured temperature(s), e.g., electronic temperature-reporting means, to the computer(s). The regulating of quenching steam/desuperheated steam amount can be carried out automatically, e.g., using automated process control equipment interfaced (e.g., electronically) with valve means in flow communication with stage 62, and optionally under control of the specified computer and/or additional computers. In alternative aspects, a desired quenched decoking effluent temperature is preselected. Flow rates are measured for (i) flows of air and steam supplied to the convection section and (ii) flows of first and second quench media provided to the quench stages. The flow rates of first and/or second quench media are adjusted as needed to maintain the actual quenched decoking effluent temperature within a predetermined tolerance of the preselected value.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the invention, including all features which would be treated as equivalents thereof by those skilled in the art to which the invention pertains.

All documents described herein are incorporated by reference herein for purposes of all jurisdictions where such practice is allowed, including any priority documents and/or testing procedures to the extent they are not inconsistent with this text, provided however that any priority document not named in the initially filed application or filing documents is NOT incorporated by reference herein. As is apparent from the foregoing general description and the specific embodiments, while forms of the invention have been illustrated and described, various modifications can be made without departing from the spirit and scope of the invention. Accordingly, it is not intended that the invention be limited thereby. Unless otherwise stated, all percentages, parts, ratios, etc. are by weight. Unless otherwise stated, a reference to a compound or component includes the compound or component by itself, as well as in combination with other compounds or components, such as mixtures of compounds. Further, when an amount, concentration, or other value or parameter is given as a list of upper preferable values and lower preferable values, this is to be understood as specifically disclosing all ranges formed from any pair of an upper preferred value and a lower preferred value, regardless of whether ranges are separately disclosed. Likewise, the term "comprising" is considered synonymous with the term "including". Likewise whenever a composition, an element or a group of elements is preceded with the transitional phrase "comprising," it is understood that we also contemplate the same composition or group of elements with transitional phrases "consisting essentially of," "consisting of," "selected from the group of consisting of," or "is" preceding the recitation of the composition, element, or elements and vice versa. Aspects of the invention include those that are substantially free of, essentially free of, or completely free of any element, step, composition, ingredient or other claim element not expressly recited or described.

What is claimed is:

1. A hydrocarbon pyrolysis process, the process comprising:

(a) providing (i) a pyrolysis furnace, the pyrolysis furnace comprising at least one radiant coil, (ii) first and second quench stages, the first quench stage being located upstream of the second quench stage, (iii) a hydrocarbon feed, (iv) a quench oil, (v) a decoking feed, and (vi) first and second quench media, the first aqueous quench medium being primarily liquid phase and the second aqueous quench medium being primarily vapor phase;

(b) providing a flow of the hydrocarbon feed to the pyrolysis furnace and providing a flow of the quench oil to the first quench stage;

(c) pyrolysing at least a portion of the hydrocarbon feed in the radiant coil to (i) produce a radiant coil effluent and (ii) deposit coke in the radiant coil;

(d) contacting the radiant coil effluent with the quench oil in the first quench stage to produce a quenched product mixture;

(e) (i) decreasing the flow of hydrocarbon feed and providing a flow of the decoking feed to the pyrolysis furnace (ii) decreasing the flow of quench oil and providing a flow of the first aqueous quench medium to the first quench stage, and (iii) providing a flow of the second aqueous quench medium to the second quench stage;

(f) contacting the decoking feed with the deposited coke to remove at least a portion of the deposited coke from the radiant coil and produce a decoking effluent;

(g) contacting the decoking effluent with the first aqueous quench medium in the first quench stage to produce a partially quenched decoking effluent that ≥90% (vol. basis) vapor phase; and (h) contacting the partially quenched decoking effluent with the second aqueous quench medium in the second quench stage to produce a quenched decoking effluent that is ≥90% (vol. basis) vapor phase.

2. The process of claim 1, wherein ≥95% (vol. basis) of the decoking effluent is in the vapor phase, ≥90% (vol. basis) of the first aqueous quench medium is provided to the first quench stage in the liquid phase, ≥90% (vol. basis) of the second aqueous quench medium is provided to the second quench stage in the vapor phase, ≥95% (vol. basis) of the partially-quenched decoking effluent exits the first quench stage in the vapor phase, and ≥95% (vol. basis) of the quenched decoking effluent exits the second quench stage in the vapor phase.

3. The process of claim 1, wherein the first aqueous quench medium is liquid water.

4. The process of claim 1, wherein the second aqueous quench medium is steam.

5. The process of claim 1, further comprising at least one vapor/liquid separator integrated with the pyrolysis furnace for removing from the hydrocarbon feed at least a portion of any non-volatiles, wherein the vapor/liquid separator is located upstream of the radiant coil.

6. The process of claim 1, wherein ≥99% (vol. basis) of the first aqueous quench medium is provided to the first quench stage in the liquid phase, ≥99% (vol. basis) of the second aqueous quench medium is provided to the second quench stage in the vapor phase, ≥99% (vol. basis) of the partially-quenched decoking effluent exits the first quench stage in the vapor phase, and ≥99% (vol. basis) of the quenched decoking effluent exits the second quench stage in the vapor phase.

7. The method of claim 1, further comprising regulating the flow of the first aqueous quench medium to maintain the partially-quenched decoking effluent within a temperature range of from 425.0° C. to 550.0° C.

8. The method of claim 1, wherein the first aqueous quench medium is water and the second aqueous quench medium is desuperheated steam.

9. The method of claim 1, further comprising regulating the flow of the second aqueous quench medium to maintain the quenched decoking effluent in a temperature range of from 370.0° C. to 480.0° C.

10. The process claim 1, wherein (i) the pyrolysis furnace further comprises at least one firebox located proximate to the radiant coil for transferring heat to the radiant coil and (ii) the process further comprises conducting at least a portion of the quenched decoking effluent to the firebox.

11. A steam cracker decoking process, comprising:

(a) providing a steam cracker, the steam cracker including at least one radiant coil;

(b) providing a flow of decoking feed to the radiant coil under conditions to remove from the radiant coil at least a portion of any coke deposits, and conducting a decoking effluent away from the radiant coil;

(c) cooling the decoking effluent with a first aqueous quench medium to provide a partially-quenched decoking effluent, wherein ≥90% (vol. basis) of the first aqueous quench medium is liquid phase before the cooling and ≥90% (vol. basis) of the partially-quenched decoking effluent is vapor phase after the cooling; and (d) further cooling the partially-quenched decoking effluent with a second aqueous quench medium to provide a quenched decoking effluent, wherein ≥90% (vol. basis) of the second aqueous quench medium is vapor phase before the further cooling and ≥90% (vol. basis) of the quenched decoking effluent is vapor phase after the further cooling.

12. The process of claim 11, further comprising the steps of (e) discontinuing the flow of decoking feed to the radiant coil and returning the radiant coil to steam cracking service.

13. The process of claim 11, wherein the steam cracker comprises a plurality of radiant coils.

14. The process of claim 11, wherein (i) the steam cracker further comprises at least one convection coil in fluidic communication with the radiant coil, (ii) the decoking feed comprises air and steam, and (iii) the decoking feed is preheated in the convection coil.

15. The process of claim 11, wherein the first aqueous quench medium comprises water and the second aqueous quench medium comprises steam.

16. The process of claim 11, wherein the second aqueous quench medium comprises desuperheated steam.

17. The process of claim 11, further comprising regulating the first aqueous quench medium amount in step (c) to maintain the partially-quenched decoking effluent within a temperature range of from 425.0° C. to 550.0° C.

18. The process of claim 11, further comprising regulating the second aqueous quench medium amount in step (d) to maintain the quenched decoking effluent in a temperature range of from 370.0° C. to 480.0° C.

19. The process of claim 11, wherein ≥90% (vol. basis) of the partially quenched decoking effluent exits the first quench stage in the vapor phase and ≥99% (vol. basis) of the quenched decoking effluent exits the second quench stage in the vapor phase.

20. The process of claim 11, wherein substantially all of the partially quenched decoking effluent exits the first quench stage in the vapor phase and substantially all of the quenched decoking effluent exits the second quench stage in the vapor phase.

* * * * *